US006126529A

United States Patent [19]

Heyer

[11] Patent Number: 6,126,529

[45] Date of Patent: Oct. 3, 2000

[54] BELT SANDER STABILIZER

[76] Inventor: Thomas Heyer, Box 316, Wysox, Pa. 18854

[21] Appl. No.: 09/329,000

[22] Filed: Jun. 10, 1999

[51] Int. Cl.[7] ..... B24B 19/00

[52] U.S. Cl. ..... 451/415; 451/451; 451/457

[58] Field of Search ..... 451/296, 303, 451/415, 438, 442, 451, 453, 455, 454, 355, 457; 30/296.1; 83/825

[56] References Cited

U.S. PATENT DOCUMENTS 3,902,284 9/1975 Hestily ..... 451/355

4,178,723 12/1979 Fleckenstein et al. ..... 451/355

4,462,381 7/1984 Fushiya et al. ..... 451/451

*Primary Examiner*—Derris H. Banks

[57] ABSTRACT

A belt sander stabilizer for keeps a sander body and the portion of the sander belt that makes contact with the surface being sanded level during operation. The belt sander includes a shield having an upper panel and a pair of lateral sides that downwardly extend from side edges of the upper panel. A pair of support arms are pivotally coupled to the lateral sides and are adapted for engaging a surface to be sanded.

9 Claims, 2 Drawing Sheets

BELT SANDER STABILIZER

BACKGROUND OF THE INVENTION

1. Field of the Invention

The present invention relates to stabilizing devices and more particularly pertains to a new belt sander stabilizer for keeps a sander body and the portion of the sander belt that makes contact with the surface being sanded level during operation.

2. Description of the Prior Art

The use of stabilizing devices is known in the prior art. More specifically, stabilizing devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,313,285; U.S. Pat. No. 5,421,126; U.S. Pat. No. 3,668,809; U.S. Pat. No. 1,916,543; U.S. Pat. No. 5,403,229; and U.S. Pat. No. Des. 303,206.

While these devices fulfill their respective, particular objectives and requirements, the aforementioned patents do not disclose a new belt sander stabilizer. The inventive device includes an upper panel. A pair of lateral sides downwardly extend from side edges of the upper panel. A pair of support arms are pivotally coupled to the lateral sides and are adapted for engaging a surface to be sanded.

In these respects, the belt sander stabilizer according to the present invention substantially departs from the conventional concepts and designs of the prior art, and in so doing provides an apparatus primarily developed for the purpose of keeps a sander body and the portion of the sander belt that makes contact with the surface being sanded level during operation.

SUMMARY OF THE INVENTION

In view of the foregoing disadvantages inherent in the known types of stabilizing devices now present in the prior art, the present invention provides a new belt sander stabilizer construction wherein the same can be utilized for keeps a sander body and the portion of the sander belt that makes contact with the surface being sanded level during operation.

The general purpose of the present invention, which will be described subsequently in greater detail, is to provide a new belt sander stabilizer apparatus and method which has many of the advantages of the stabilizing devices mentioned heretofore and many novel features that result in a new belt sander stabilizer which is not anticipated, rendered obvious, suggested, or even implied by any of the prior art stabilizing devices, either alone or in any combination thereof.

To attain this, the present invention generally comprises a pair of support arms pivotally coupled to lateral sides of a protective cover of a belt sander and are adapted for engaging a surface to be sanded.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new belt sander stabilizer apparatus and method which has many of the advantages of the stabilizing devices mentioned heretofore and many novel features that result in a new belt sander stabilizer which is not anticipated, rendered obvious, suggested, or even implied by any of the prior art stabilizing devices, either alone or in any combination thereof.

It is another object of the present invention to provide a new belt sander stabilizer which may be easily and efficiently manufactured and marketed.

It is a further object of the present invention to provide a new belt sander stabilizer which is of a durable and reliable construction.

An even further object of the present invention is to provide a new belt sander stabilizer which is susceptible of a low cost of manufacture with regard to both materials and labor, and which accordingly is then susceptible of low prices of sale to the consuming public, thereby making such belt sander stabilizer economically available to the buying public.

Still yet another object of the present invention is to provide a new belt sander stabilizer which provides in the apparatuses and methods of the prior art some of the advantages thereof, while simultaneously overcoming some of the disadvantages normally associated therewith.

Still another object of the present invention is to provide a new belt sander stabilizer that keeps a sander body and the portion of the sander belt that makes contact with the surface being sanded level during operation.

Yet another object of the present invention is to provide a new belt sander stabilizer which includes a pair of support arms pivotally coupled to lateral sides of a protective cover of a belt sander that are adapted for engaging a surface to be sanded.

Still yet another object of the present invention is to provide a new belt sander stabilizer that prevents the sander from digging into the surface being sanded and removing too much material, thereby preventing ruining the surface due to surface gouging and marring.

Even still yet another object of the present invention is to provide a new belt sander stabilizer that prevents tilting of the sander, thereby preventing uneven sanding.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
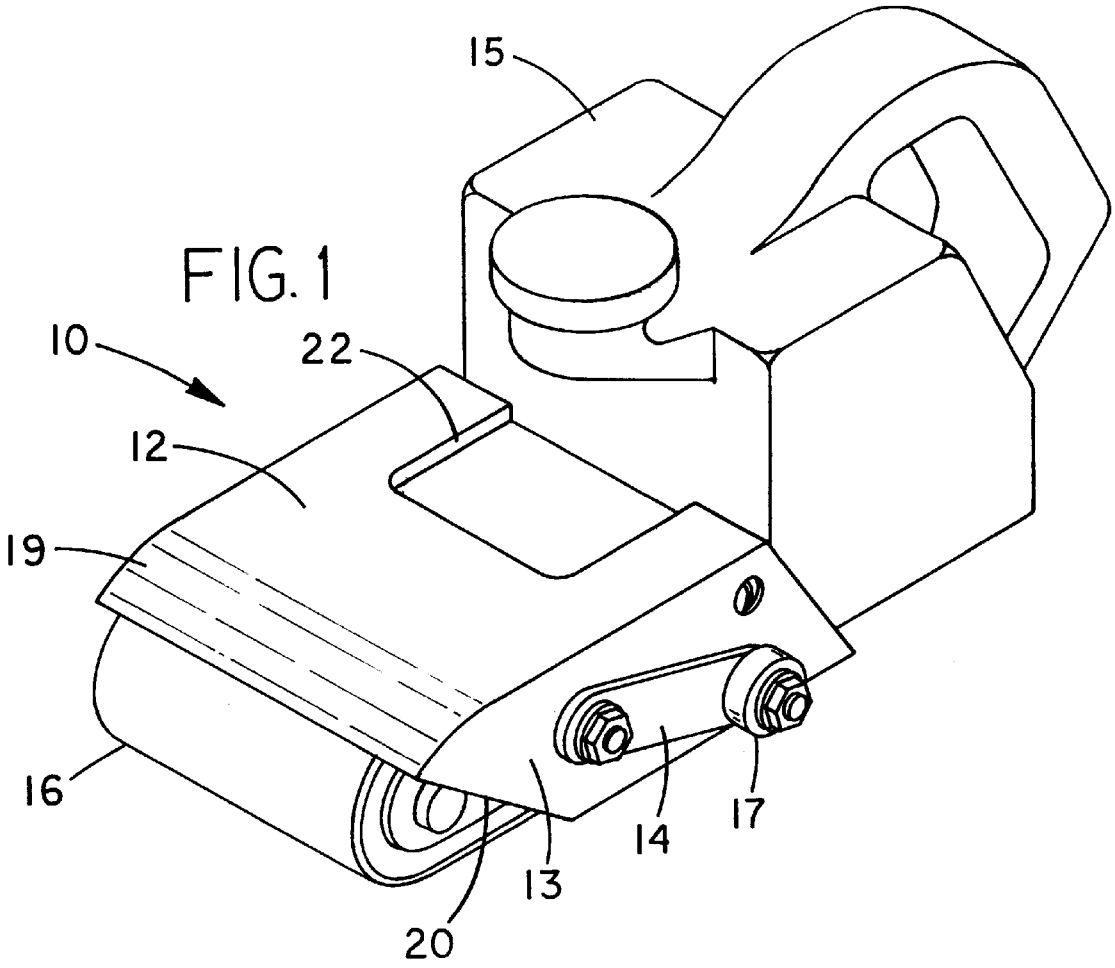
FIG. 1 is a schematic perspective view of a new belt sander stabilizer according to the present invention.
Figure 2:
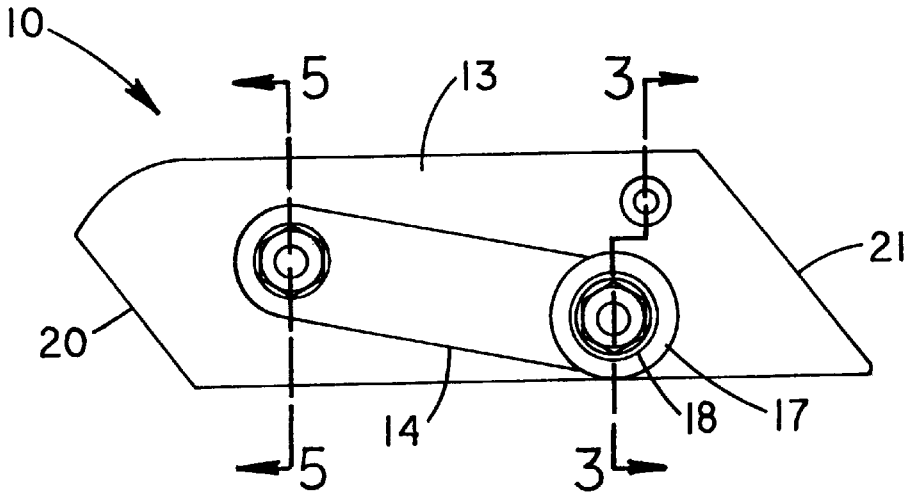
FIG. 2 is a schematic side view of the present invention.
Figure 3:
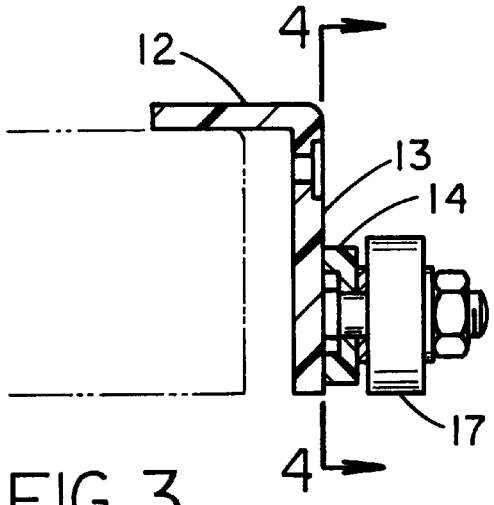
FIG. 3 is a schematic cross sectional view of the present invention taken from line 3—3 of FIG. 2.
Figure 4:
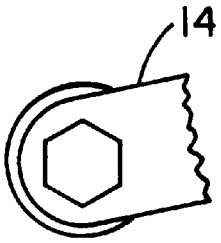
FIG. 4 is a schematic cross sectional view of the present invention taken from line 4—4 of FIG. 3.
Figure 5:
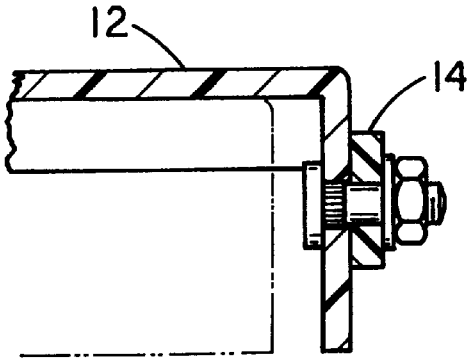
FIG. 5 is a schematic cross sectional view of the present invention taken from line 5—5 of FIG. 2.

With reference now to the drawings, and in particular to FIGS. 1 through 5 thereof, a new belt sander stabilizer embodying the principles and concepts of the present invention and generally designated by the reference numeral 10 will be described.

As best illustrated in FIGS. 1 through 5, the belt sander stabilizer 10 is adapted for mounting to a shield 11 of a belt sander 15. The shield has an upper panel 12 and a pair of lateral sides 13 that downwardly extend from side edges of the upper panel. The stabilizer generally comprises a pair of support arms 14 that are pivotally coupled to the lateral sides and are adapted for engaging a surface to be sanded.

The belt sander has a sanding belt 16. The stabilizing device may be mounted to the shield of the belt sander or a pair of flanges (not shown) extending from the belt sander by a pair of threaded fasteners. Each of the support arms has an end 25. The end has a bore 26 and a bolt 27 through the bore. The bolt is coupled to one of the lateral sides of the shield such that the end of the support arms pivots freely around the bolt.

Preferably, each of the support arms has a roller 17 rotatably coupled to it that is adapted for rolling along a surface to be sanded. Ideally, each roller has a sealed bearing 18. This is required to ensure easy rolling of the roller along the surface. Without the sealed bearing, the roller could become clogged with sawdust.

Also preferably, a front portion 19 of the upper panel curves downwardly along the contour of the front of the roller. This directs sawdust and debris down towards the surface being sanded.

Preferably, a front edge 20 of each of the lateral sides tapers rearwardly from the front portion of the upper panel towards a bottom edge of the lateral side. This is required to permit tilting of the sander forward to concentrate sanding pressure on the front of the belt.

Also preferably, a rear edge 21 of each of the lateral sides tapering rearwardly from the upper panel towards the bottom edge of the lateral side. This helps prevent sawdust from spraying out the sides of the sander.

Preferably, the upper panel has a notch 22 extending forwardly from a rear edge thereof. This is required to permit sawdust to exit from under the upper panel, thereby preventing clogging.

The preferred width of the upper panel between the side walls is about three inches. The preferred height of each of the side walls between its upper and lower edges is about one inch.

In use, the desired sanding depth is set by pivoting the support arms downwardly away from the upper panel until the distance between a plane extending across the lower surface of the sanding belt and a plane extending across the rollers is equal to the desired sanding depth. The sander is turned on and pushed back and forth along the surface being sanded.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A sanding system, comprising in combination:

a belt sander having a sanding belt and a shield having an upper panel and a pair of lateral sides downwardly extending from side edges of said upper panel; and a support arm pivotally coupled to each of said lateral sides of said shield and adapted for engaging a surface to be sanded.

2. The stabilizing device of claim 1, wherein each of said support arms has a roller coupled thereto adapted for rolling along a surface to be sanded.

3. The stabilizing device of claim 2, wherein each of said rollers has a sealed bearing.

4. The stabilizing device of claim 1, wherein a front portion of said upper panel curves downwardly.

5. The stabilizing device of claim 1, wherein a front edge of each of said lateral sides tapers rearwardly from said front portion of said upper panel towards a bottom edge of said lateral side.

6. The stabilizing device of claim 1, wherein a rear edge of each of said lateral sides taper rearwardly from said upper panel towards a bottom edge of said lateral side.

7. The stabilizing device of claim 1, wherein said upper panel has a notch extending forwardly from a rear edge thereof.

8. The stabilizing device of claim 1, wherein each of said support arms having an end, said end having a bore and a bolt through said bore, said bolt being coupled to one of said lateral sides of said shield such that said end of said support arms pivots freely around said bolt.

9. A sanding system, comprising in combination:

a belt sander having a sanding belt and a shield having an upper panel and a pair of lateral sides downwardly extending from side edges of said upper panel;

a stabilizing device mounted to said belt sander, said stabilizing device comprising:

a support arms pivotally coupled to each of said lateral sides of said shield and adapted for engaging a surface to be sanded, each of said support arms having an end, said end having a bore and a bolt through said bore, said bolt being coupled to one of said lateral sides of said shield such that said end of said support arms pivots freely around said bolt;

each of said support arms having a roller coupled thereto adapted for rolling along a surface to be sanded; and wherein each of said rollers has a sealed bearing;

a front portion of said upper panel curving downwardly;

a front edge of each of said lateral sides tapering rearwardly from said front portion of said upper panel towards a bottom edge of said lateral side;

a rear edge of each of said lateral sides tapering rearwardly from said upper panel towards said bottom edge of said lateral side; and said upper panel having a notch extending forwardly from a real edge thereof.

* * * * *